US006719371B2

(12) United States Patent
Yoshie et al.

(10) Patent No.: US 6,719,371 B2
(45) Date of Patent: Apr. 13, 2004

(54) CHILD CHAIR

(75) Inventors: Toshiro Yoshie, Tokyo-To (JP); Yutaka Ukitsu, Tokyo-To (JP); Tokihiko Ikuno, Tokyo-To (JP)

(73) Assignee: Combi Corporation, Tokyo (JP)

( * ) Notice: Subject to any disclaimer, the term of this patent is extended or adjusted under 35 U.S.C. 154(b) by 0 days.

(21) Appl. No.: 10/195,429

(22) Filed: Jul. 16, 2002

(65) Prior Publication Data

US 2003/0011221 A1 Jan. 16, 2003

(30) Foreign Application Priority Data

Jul. 16, 2001 (JP) ..... 2001-214843

(51) Int. Cl.[7] ..... A47C 1/02

(52) U.S. Cl. ..... 297/344.15; 297/344.14; 297/354.13

(58) Field of Search ..... 297/344.14, 344.15, 297/130, 129, 131, 383, 148, 153, 56, 152, 16.2, 16.1; 280/640, 641, 647, 648, 650, 657, 658; 248/420, 176.3

(56) References Cited

U.S. PATENT DOCUMENTS 1,949,282 A * 2/1934 Murray ..... 297/18
1,975,689 A * 10/1934 Hall ..... 297/18
3,004,793 A * 10/1961 Loomis ..... 297/274
3,145,048 A * 8/1964 Dowdy et al. ..... 29/5
3,152,833 A * 10/1964 Creveling et al. ..... 297/140
3,649,074 A * 3/1972 McDonald et al. ..... 297/153
4,019,756 A 4/1977 Ishida
4,359,242 A 11/1982 Gerken et al.
4,576,392 A 3/1986 Quinlan, Jr.
4,621,804 A 11/1986 Mueller
4,623,163 A * 11/1986 Potts ..... 280/649
4,719,663 A 1/1988 Termini
4,759,541 A 7/1988 Chen
4,892,327 A * 1/1990 Cabagnero ..... 280/650
5,324,064 A 6/1994 Sumser et al.
5,564,724 A 10/1996 Huang
6,196,629 B1 * 3/2001 Onishi et al. ..... 297/256.12
6,554,359 B2 * 4/2003 Kohl et al. ..... 297/338
2002/0113469 A1 * 8/2002 Stern et al. ..... 297/256.16

FOREIGN PATENT DOCUMENTS

FR 45552 E 10/1935

* cited by examiner

*Primary Examiner*—Peter M. Cuomo
*Assistant Examiner*—Erika Garrett
(74) *Attorney, Agent, or Firm*—Birch, Stewart, Kolasch & Birch, LLP

(57) ABSTRACT

Each of right and left X-shaped leg assemblies (2) is constructed by pivotally joining middle parts of a front leg (3) and a rear leg (4). The right and the left X-shaped leg assembly (2) are connected to parallel right and left bases (8). One of the front leg (3) and the rear leg (4) of each X-shaped leg assembly (2) has a lower end pivotally connected to the base (8), and the other of the front leg (3) and the rear leg (4) has a lower end supported for turning and longitudinal movement on the base (8).

12 Claims, 11 Drawing Sheets

CHILD CHAIR

TECHNICAL FIELD

The present invention relates to a height-adjustable child chair for an infant, such as a newborn baby, a baby or a child.

BACKGROUND ART

There has been proposed and practically used a child chair capable of moving in the room on wheels attached to its legs, and having adjustable height that can be adjusted to set a child seat thereon at a level suitable for taking a meal. This known child chair has a pair of X-shaped leg assemblies each formed by pivotally joining middle parts of a front leg and a rear leg, and a seat supported on the leg assemblies. The front legs and the rear legs are turned toward or away from each other for height adjustment. Casters are attached particularly to the lower ends of the front legs to facilitate changing moving direction.

In order to set the child chair provided with the X-shaped leg assemblies in a comparatively big height, the front and the rear legs need to be long, and therefore the child chair needs a large area in front and at the back when storing the folded child chair. When the casters are attached to the lower ends of the legs, the axes of the casters deviate from the vertical when the inclination of the legs is changed for height adjustment and, consequently, the child chair is unable to move smoothly. Therefore, the child chair needs an angle adjusting mechanism for correcting the angular position of the axes of the casters according to the inclination of the legs to maintain the axes of the casters always perpendicular to the floor.

DISCLOSURE OF THE INVENTION

The present invention has been made in view of the foregoing problem and it is therefore an object of the present invention to provide a child chair requiring a comparatively small area in front and in the back when folded, and not requiring the adjustment of the angular position of casters.

According to the present invention, a child chair includes: a pair of elongate bases; X-shaped leg assemblies, each formed by pivotally joining a front leg and a rear leg, and connected to the base; and a child seat supported on the pair of X-shaped leg assemblies; wherein one of the front or the rear legs of each X-shaped leg assembly has a lower end pivotally connected to the base, and the other of the front or the rear legs has a lower end pivotally supported on the base and movable in a longitudinal direction.

In the child chair according to the present invention, each base is provided with a longitudinal groove, a guide rod is extended in the groove, a slide block is engaged with the guide rod so as to slidably move, and the movable lower end of either the front or the rear leg is pivotally connected to the slide block.

In the child chair according to the present invention, the slide block has a sliding part slidably engaged with the guide rod, and a raised part longitudinally extending outwardly from the sliding part, the lower end of either the front or the rear leg is pivotally connected to the raised part.

In the child chair according to the present invention, the raised part of the slide block projects outwardly from the base when the X-shaped leg assembly is folded.

In the child chair according to the present invention, middle parts of the pair of bases are curved such that a space between front parts of the bases and a space between rear parts of the bases are different from each other, the front leg of each X-shaped leg assembly is connected to the front part of the base, and rear leg of each X-shaped leg assembly is connected to the rear part of the base.

In the child chair according to the present invention, casters are detachably connected to the lower surface of each of the bases.

In the child chair according to the present invention, seat support members are connected to the upper ends of the pair of X-shaped leg assemblies, respectively, and the child seat is supported in a swinging manner on the seat support members.

In the child chair according to the present invention, the child seat has a bottom member, a back member pivotally connected to a rear part of the bottom member, a headrest pivotally connected to an upper part of the back member for turning, and a step connected in a swinging manner to a front part of the bottom member.

In the child chair according to the present invention, a connecting bar is extended between the back member and the step to interlock the back member and the step.

In the child chair according to the present invention, recesses are formed at intervals on the back surface of the back member, and a support bar is pivotally supported on the bottom member so as to engage in one of the recesses of the back member.

In the child chair according to the present invention, the headrest is supported for turning on the back member by a support shaft, a connecting member has one end pivotally connected to a part of the headrest, which is eccentric with respect to a shaft supporting the headrest, and the other end of the connecting member pushed by the support bar.

In the child chair according to the present invention, a swing cover is supported for turning on the back surface of the back member.

In the child chair according to the present invention, the swing cover is provided with slots through which the support bar is extended.

BEST MODE FOR CARRYING OUT THE INVENTION

A preferred embodiment of the present invention will be described with reference to the accompanying drawings.

Figure 1:
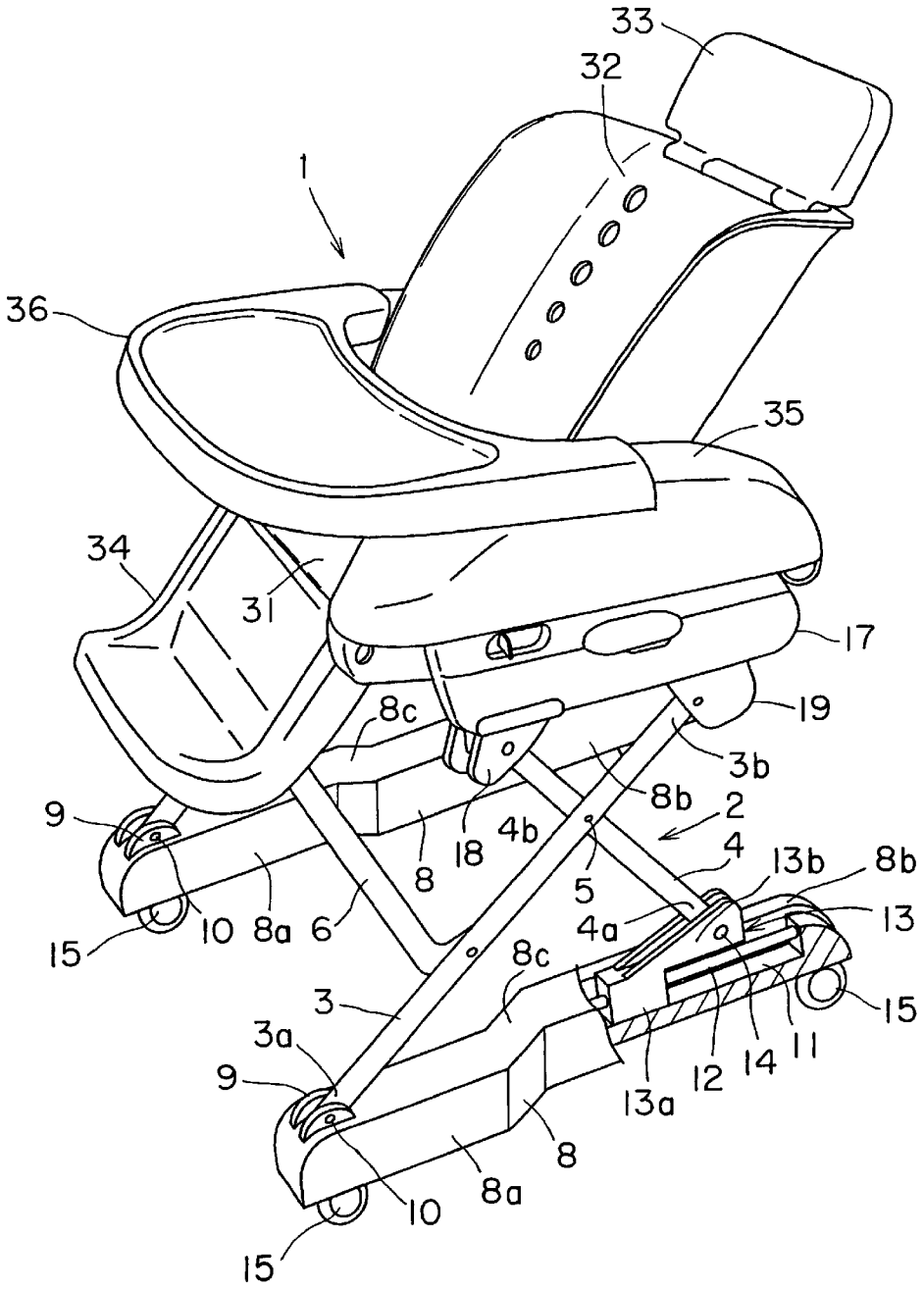
FIG. 1 is a perspective view of a child chair in a preferred embodiment according to the present invention.

Referring to FIG. 1 showing a child chair in a preferred embodiment according to the present invention in a schematic perspective view, the child chair comprises a pair of X-shaped leg assemblies 2 and a child seat unit (child seat)/supported on the assemblies 2. Each X-shaped leg assembly 2 is constructed by pivotally joining respective middle parts of a front leg 3 and a rear leg 4 with a pin 5. A front connecting rod 6 connects the right and the left front leg 3, a rear connecting rod 7 (FIG. 2) connects the right and the left rear leg 4.

Lower end parts of the X-shaped leg assemblies 2 are connected to elongate, right and left bases 8, respectively. The space between rear parts 8*b* of the right and the left bases 8 is smaller than that between front parts 8*a* of the same. Each front leg 3 has a lower end 3*a* pivotally connected to a support lug 9 by a pin 10. A longitudinal groove 11 opening upward is formed in the rear part 8*b* of each base 8. A guide rod 12 is extended longitudinally in the groove 11, and a slide block 13 is mounted on the guide rod 12 for sliding along the guide rod 12. The slide block 13 has a slide part 13*a* that slides along the guide rod 12, and a raised part 13*b* rising toward the rear from an upper part of the slide part 13*a*. The lower end 4*a* of each rear leg 4 is pivotally connected to the raised part 13*b* by a pin 14. Casters 15 are attached detachably to the lower wall of each base 8.

As mentioned above, the bases 8 have curved middle parts 8*c*, respectively, and the space between the rear parts 8*b* of the right and the left base 8 is smaller than that between the front parts 8*a* of the right and the left base 8. Therefore, the rear legs 4 on the inner side of the front legs 3 can be connected to parts of the bases 8 on the longitudinal axes of the bases 8, and hence it is possible to avoid forming the bases 8 in an excessively big width.

Figure 2:
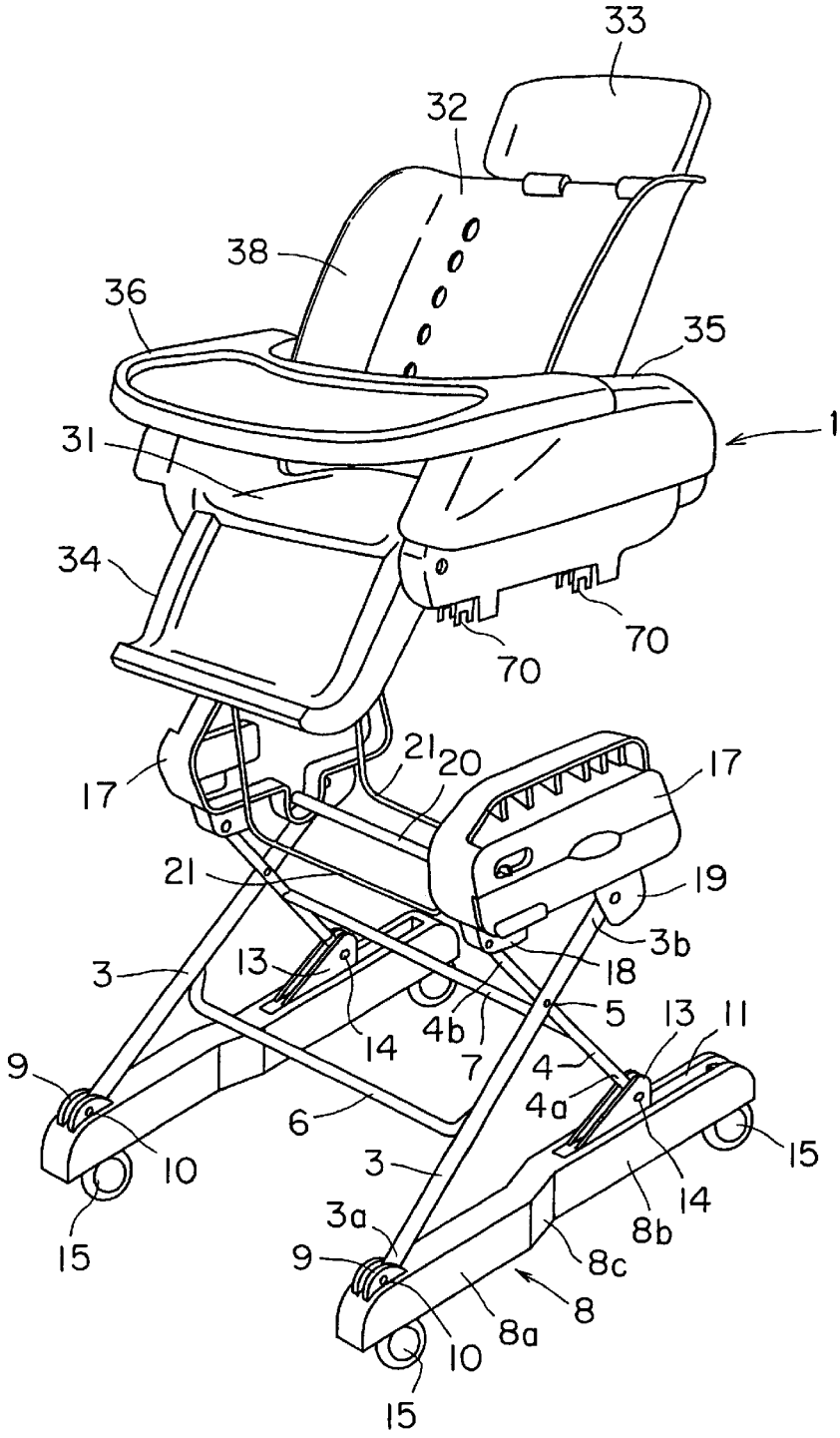
FIG. 2 is an exploded perspective view of the child chair shown in FIG. 1, in which a seat unit is separated from a leg unit.
Figure 3:
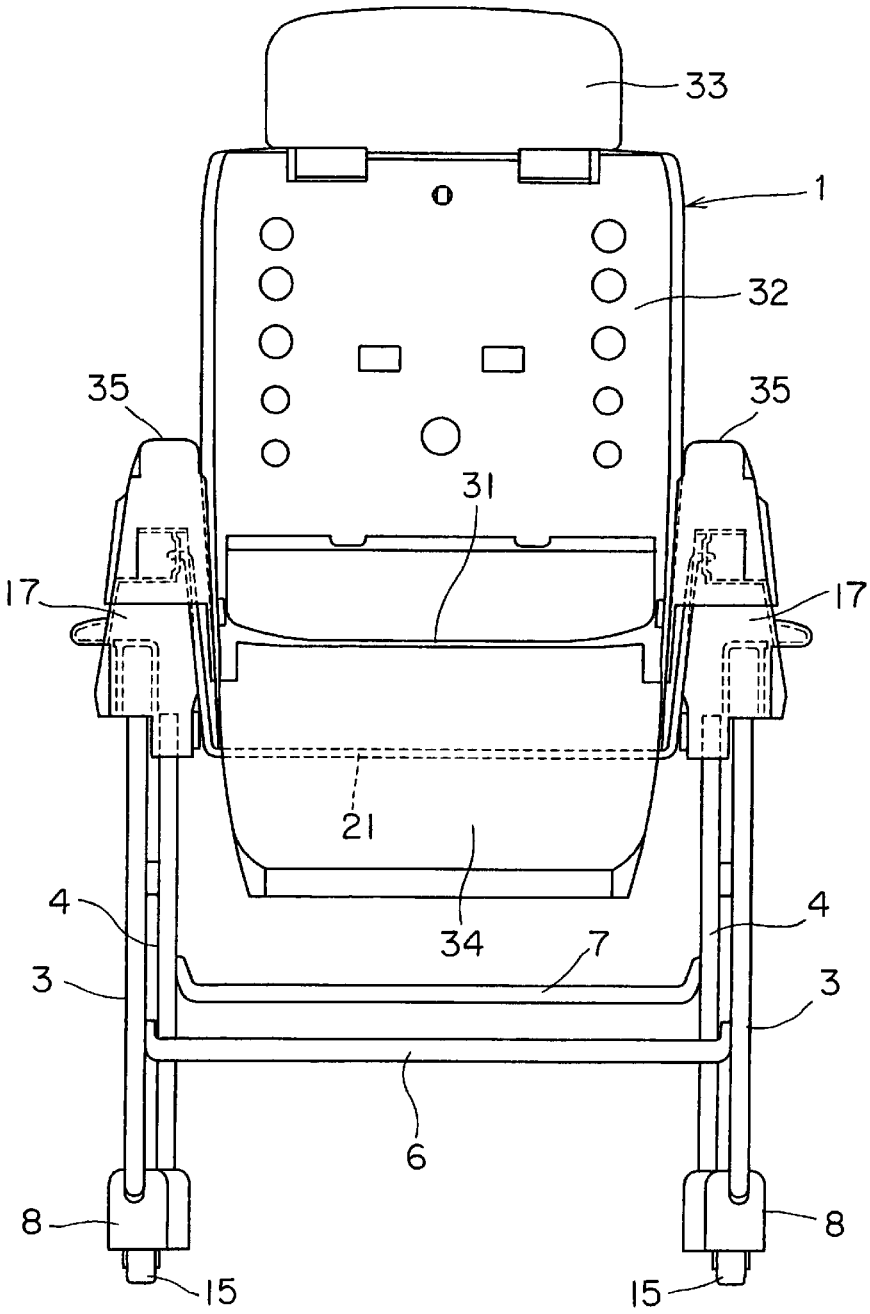
FIG. 3 is a front elevation of the child seat shown in FIG. 1, in which a table is removed.

As shown in FIG. 2, the respective upper ends 3*b* and 4*b* of the front legs 3 and the rear legs 4 of the X-shaped leg assemblies 2 are connected to a pair of seat support members 17, respectively. The upper end 4*b* of each rear leg 4 is pivotally connected to a support lug 18 formed in a front part of the seat support member 17. The upper end 3*b* of each front leg 3 is pivotally connected to a hinge plate 19 formed in a rare part of the seat support member 17. The pair of seat support members 17 correspond to the right and the left X-shaped leg assembly 2, respectively. A connecting rod 20 connects the right and the left seat support members 17. Two swing bars 21 are extended between the right and the left seat support members 17. Each swing bar 21 has the shape of the letter U, is extended so as to open upward, and has side parts having upper and bent end parts pivotally supported on the right and the left seat support member 17. Thus, the swing bar 21 is able to swing on the right and the left seat support member 17. As shown in FIG. 3, the child seat unit 1 is supported on the swing bars 21, so that the child seat unit 1 is able to swing back and forth.

Figure 4:
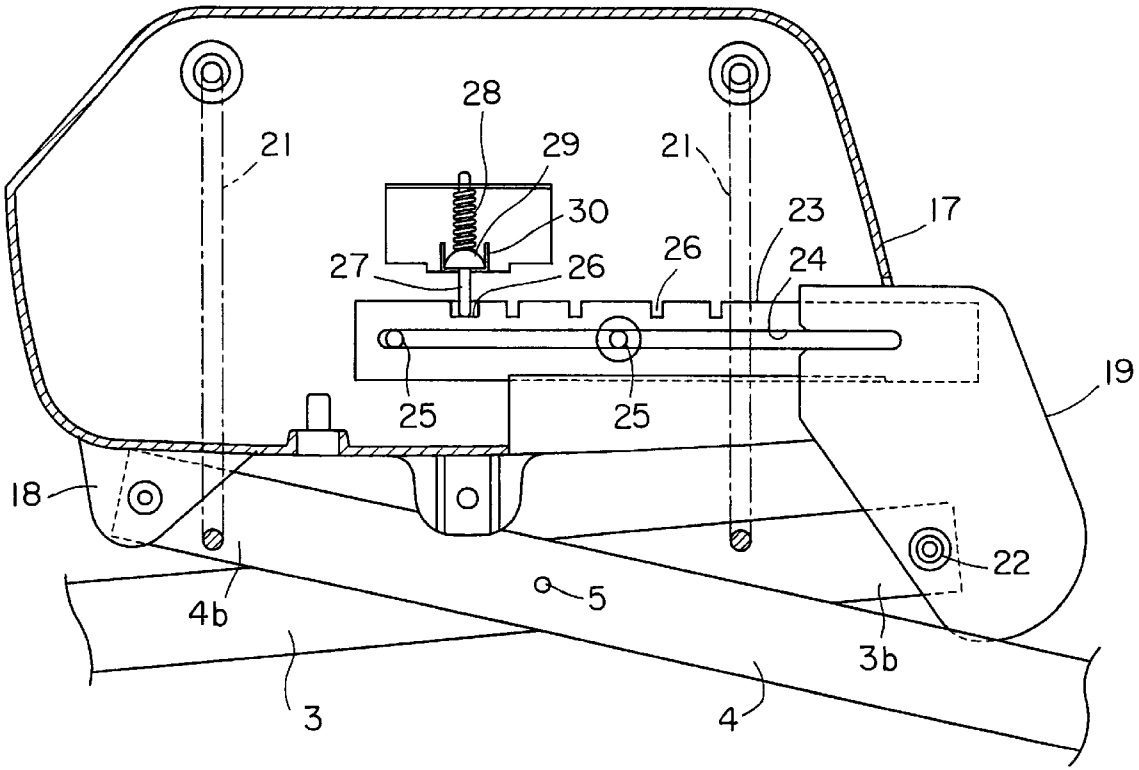
FIG. 4 is a side elevation of a connecting part for connecting an X-shaped leg assembly and a seat support member.

FIG. 4 shows a connecting part connecting the front leg 3 and the rear leg 4 to the seat support member 17. The upper end 3*b* of the front leg 3 is pivotally connected to the hinge plate 19 by a pin 22. A slide bar 23 is formed integrally with the hinge plate 19. The slide bar 23 is placed in the seat support member 17 so as to be longitudinally slidable. The slide bar 23 is provided with a longitudinal slot 24 extending into the hinge plate 19. Two pins 25 attached at a predetermined interval to the seat support member 17 are engaged in the slot 24 to support the slide bar 23 for longitudinal sliding. The slide bar 23 is urged to the left, as viewed in FIG. 4, by a spring, not shown, such that the X-shaped leg assembly 2 is extended to increase the height of the child chair.

The slide bar 23 has a square cross section. A plurality of positioning holes 26 are formed in the upper wall of the slide bar 23 on a longitudinal line. A pin 27 is supported vertically movably on the seat support member 17. The pin 27 is inserted selectively in one of the positioning holes 26. The pin 27 is pushed toward the slide bar 23 by a spring 28. An expanded part 29 formed in a middle part of the pin 27. A lever 30 is engaged with the expanded part 29 of the pin 27. The lever 30 extends through and projects from the outer sidewall of the seat support member 17, and is capable of vertical movement along the pin 27.

When the lever 30 is pulled up from the outside of the seat support member 17, the pin 27 is raised against the resilience of the spring 28 and the pin 27 is extracted from the positioning hole 27. Consequently, the slide bar 23 is moved to the left, as viewed in FIG. 4 by the spring and thereby the X-shaped leg assembly 2 extends to increase the height of the child chair shown in FIG. 1.

Figure 5:
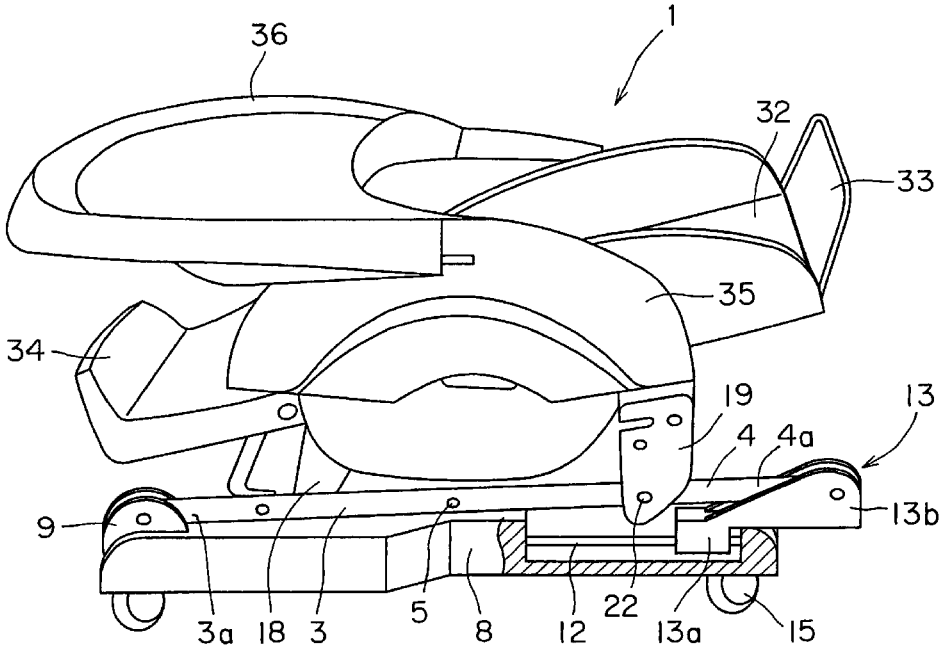
FIG. 5 is a side elevation of the child chair shown in FIG. 1 in a folded state.

On the other hand, when the pin 27 is extracted from the positioning hole 26 and the seat support member 17 is depressed, the slide bar 23 and the slide block 13 move to the right, as viewed in FIG. 1, the inclinations of the front leg 3 and the rear leg 4 decrease and. As a result, the slide bar 23 moves to the rightmost position as shown in FIG. 4, the pin 27 is engaged in the positioning hole 26, the height of the child chair is decreased to the lowest height, and therefore the child chair is folded as shown in FIG. 5.

When each X-shaped leg assembly 2 is folded, the respective lower ends 3*a* and 4*a* of the front leg 3 and the rear leg 4 are spaced the maximum distance apart from each other. However, since the lower end 4*a* of the rear leg 4 is pivotally supported on the raised part 13*b* longitudinally extending toward the rear, and the raised part 13*b* projects rearward from the rear end of each base 8 when each X-shaped leg assembly 2 is folded, the length of the base 8 may be shorter.

When the lever 30 is released while the slide bar 23 is sliding, the spring 28 pushes the pin 27 into other positioning hole 26 to retain the X-shaped leg assembly 2 in a predetermined height. The number of the positioning holes 26 is, for example, five. Therefore the height of the child seat unit 1 can be adjusted to one of five levels. Although the lower end 4*a* of the rear leg 4 is longitudinally slidable on the base 8 in this embodiment, the lower end 3*a* of the front leg 3 may be longitudinally slidable on the base 8.

As shown in FIGS. 1 and 2, the child seat unit 1 has a bottom member 31 on which a child is seated, a back member 32 disposed behind the bottom member 31, a headrest 33 connected to an upper part of the back member 32, and a step 34 pivotally connected to a front part of the bottom member 31.

Armrests 35 are formed integrally with side parts of the bottom member 31. A table 36 is detachably connected to the armrests 35. The back member 32 is supported for turning by a support shaft 37 (FIG. 6) on a rear part of the bottom member 31. Side support walls 38 are formed integrally with the back member 32 so as to extend continuously with the arm rests 35. The support shaft 37 is extended across lower parts of the side support walls 38. As show in FIG. 7, a safety belt 39 is extended on the front surface of the back member 32. The step 34 is pivotally supported by a support shaft 40 on a front part of the bottom member 31. The headrest 33 is pivotally supported by a support shaft 41 on an upper part of the back member 32.

Figure 8:
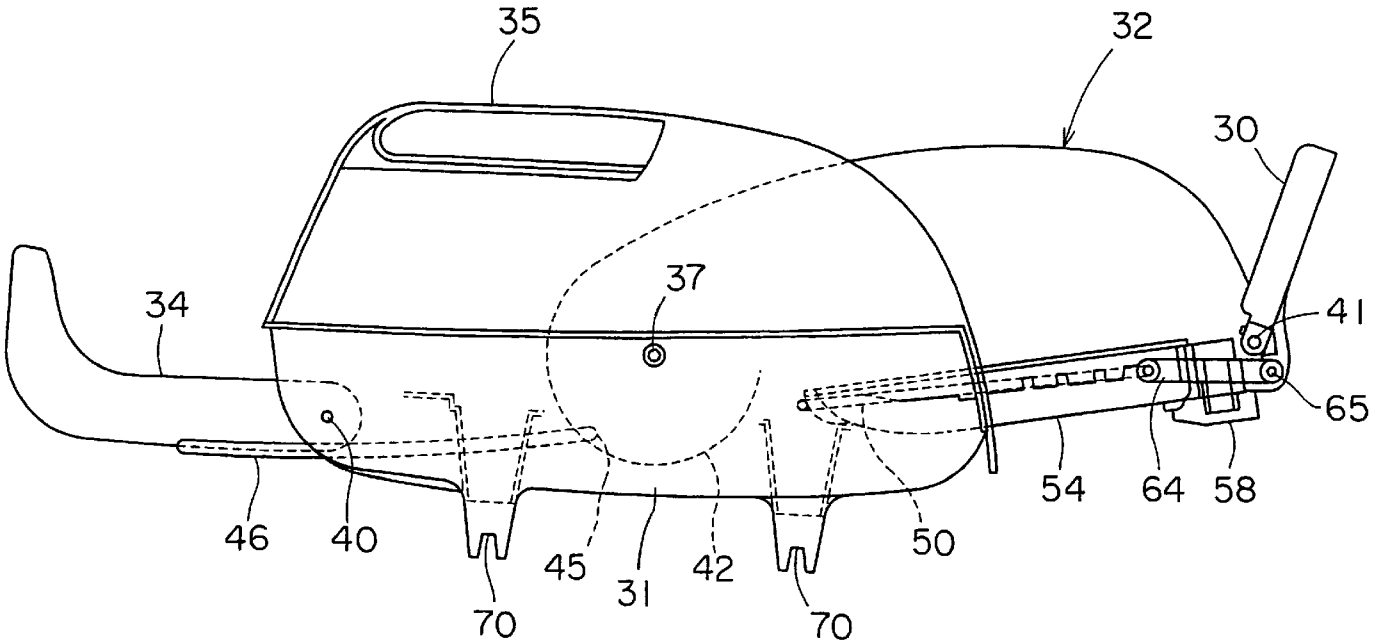
FIG. 8 is a side elevation of a bottom member.
Figure 9:
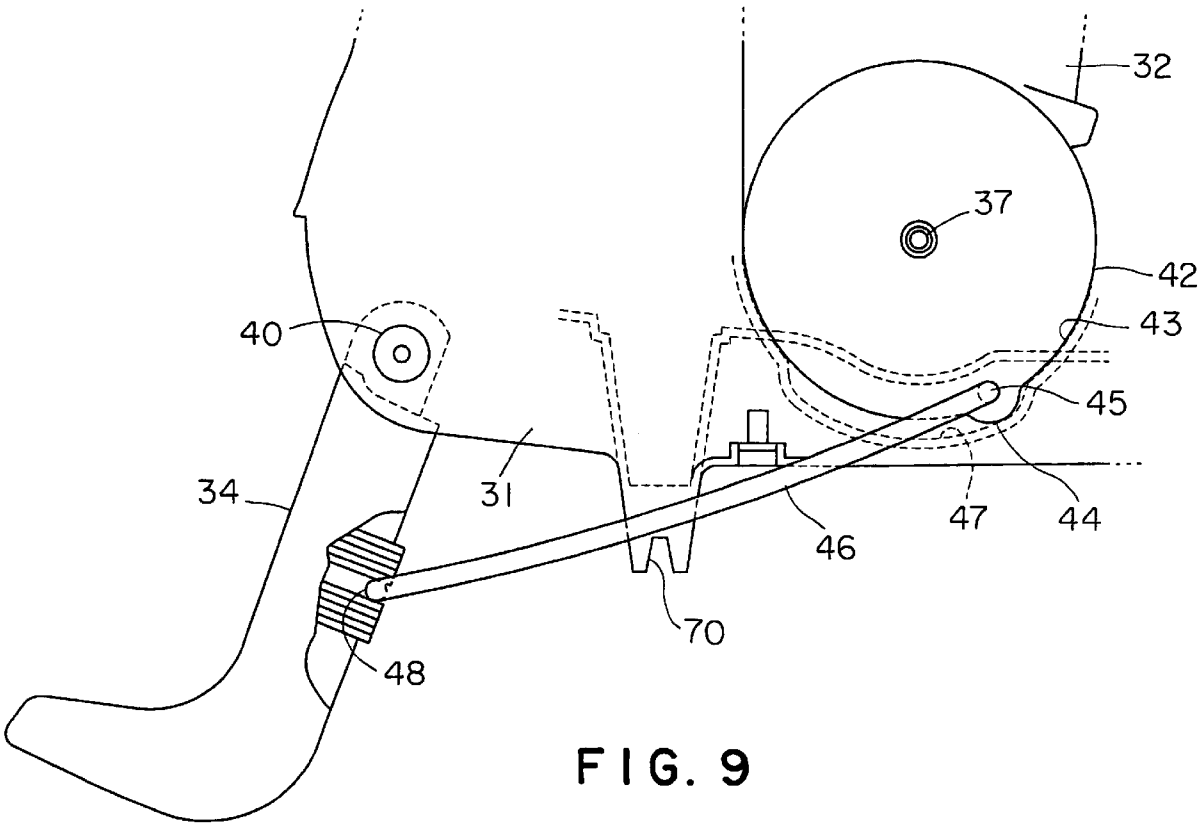
FIG. 9 is an enlarged view of a lower part of the child seat shown in FIG. 6.
Figure 10:
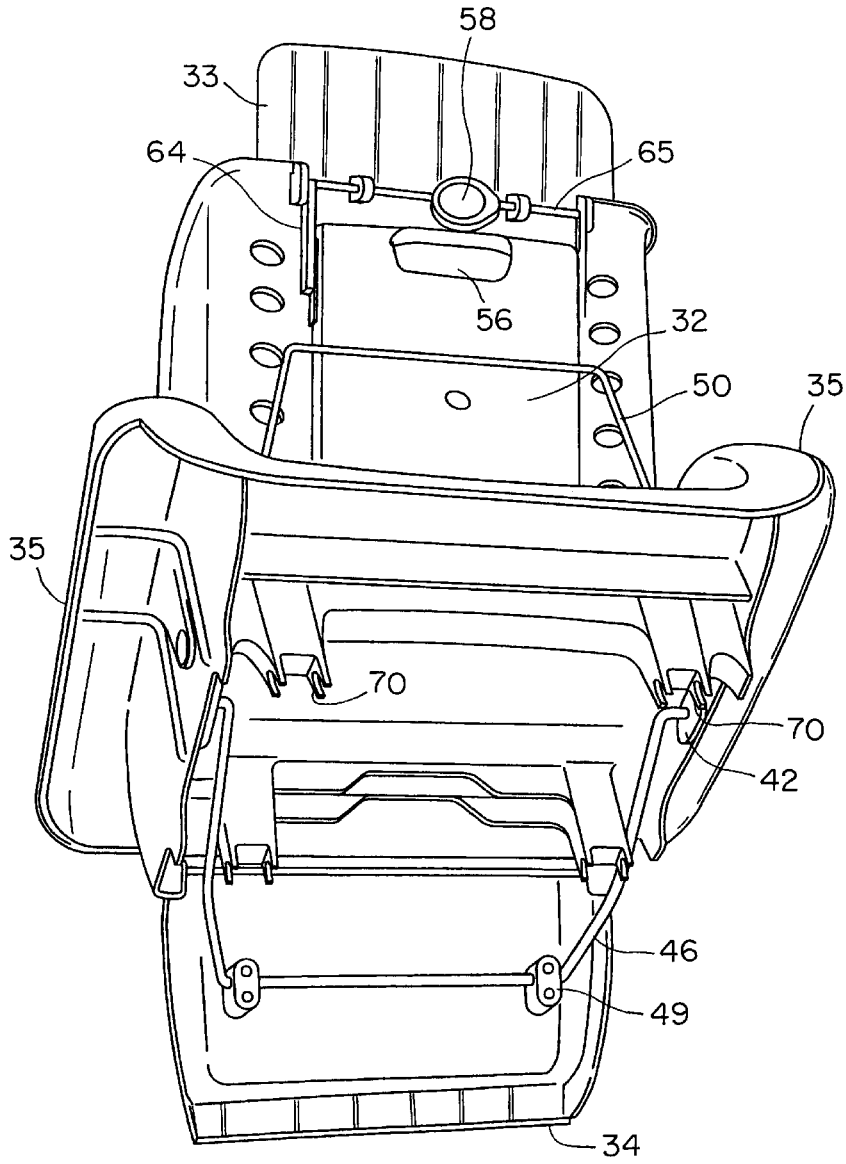
FIG. 10 is a perspective view of the child seat as viewed obliquely upward from behind the child seat.

Circular plates 42 are formed so as to surround the support shaft 37 in lower parts of the side support walls 38 of the back member 32 (FIGS. 8 and 9). Circular recesses 43 are formed in side parts of the bottom member 31. The circular plates 42 are fitted in the circular recesses 43, respectively. As shown in FIG. 10, the circular plates 42 are provided on both the right and left sides of the bottom member 31. The inner surfaces of the circular plates 42 are exposed outside the bottom member 31. A protrusion 44 is formed in an exposed part of each circular plate 42 as shown in FIG. 9. A hole 45 is formed in each protrusion 44, and one end of a connecting bar 46 is inserted so as to be turnable in the hole 45.

The connecting bar 46 is shaped generally in a U-shape, and opposite end parts of the connecting bar 46 are bent in an L-shape. The L-shaped end parts of the connecting bar 46 are inserted for turning in the holes 45 formed in the right and the left circular plates 42. A circular recess 47 is formed in the range of turning of the protrusion 44 in each circular recess 43. The opposite ends of each circular recess 47 serve as stoppers for limiting the turning of the protrusion 44.

A middle part of the U-shaped connecting bar 46 is engaged for turning in grooves 48 having a circular cross section and formed in rear parts of the step 34. Holding members 49 hold the connecting bar 46 in the grooves 48 as shown in FIG. 10.

When the back member 32 is tilted backward, i.e., in a clockwise direction as viewed in FIG. 9, relative to the bottom member 31, the connecting bar 46 connected to the back member 32 pushes the step 34 forward to turn the step 34 through a predetermined angle. Thus, the step 34 can be turned according to the tilting of the back member 32 as shown in FIG. 8 to support the legs thereon.

Figure 6:
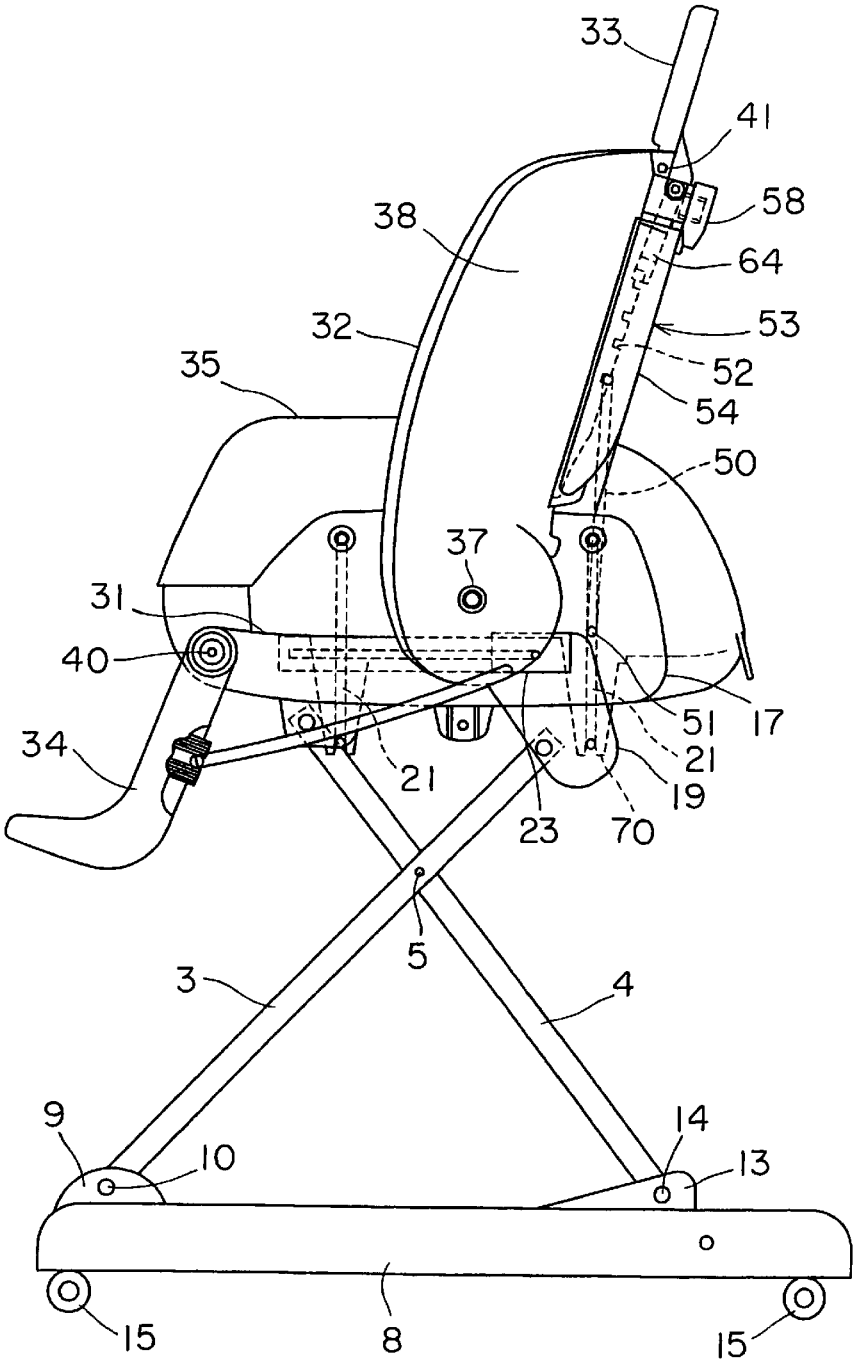
FIG. 6 is a side elevation of the child chair shown in FIG. 1.

The back member 32 is supported in an inclined position by a support bar 50 shown in FIGS. 6 and 10. The support bar 50 is formed generally in a U-shape and has opposite bent end parts bent in an L-shape. The bent end parts are inserted for turning in holes 51 (FIG. 6) formed in the bottom member 31 and are retained in the holes 51 by push nuts. Recesses 52 are formed at intervals on the back surface of the back member 32, and a middle part of the U-shaped support bar 50 is engaged in one of the recesses 52 of the back member.

Figure 11:
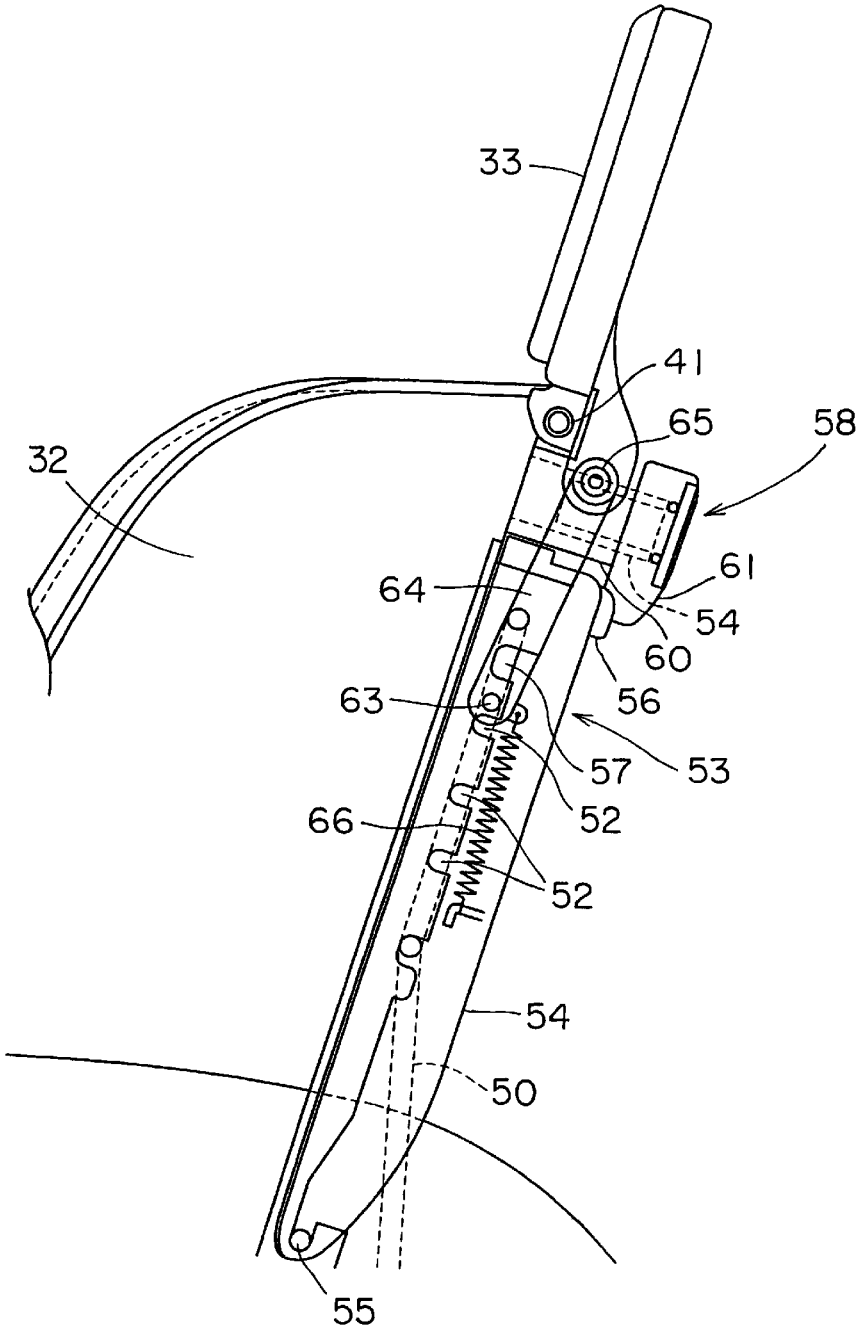
FIG. 11 is an enlarged view of assistance in explaining the construction of an upper part of the child seat.

A back member locking mechanism 53 for restraining the back member 32 from tilting is formed on the back surface of the back member 32. As shown in FIG. 11, a swing cover 54 is supported for turning by a support shaft 55 on the back surface of the back member 32 so as to cover the recesses 52 formed on the back member 32 at intervals. The swing cover 54 has the shape of a box opening to the left, as viewed in FIG. 11. The swing cover 54 can be turned on the support shaft 55 between a closed position for covering the recesses 52 and an open position for exposing the recesses 52. A handle 56 is formed on an upper part of the swing cover 54. The handle 56 is held by the fingers to turn the swing cover 54. Slots 57 are formed longitudinally in the right and left sidewalls of the swing cover 54. A middle part of the U-shaped support bar 50 is extended through the slots 57 so as to slide along the slots 57.

When the swing cover 54 is at the closed position for covering the recesses 52, the support bar 50 is engaged in one of the recesses 52. When the swing cover 54 is at the open position, the support bar 50 is engaged in none of the recesses 52 and the support bar 50 is able to slide in the slots 57.

Figure 7:
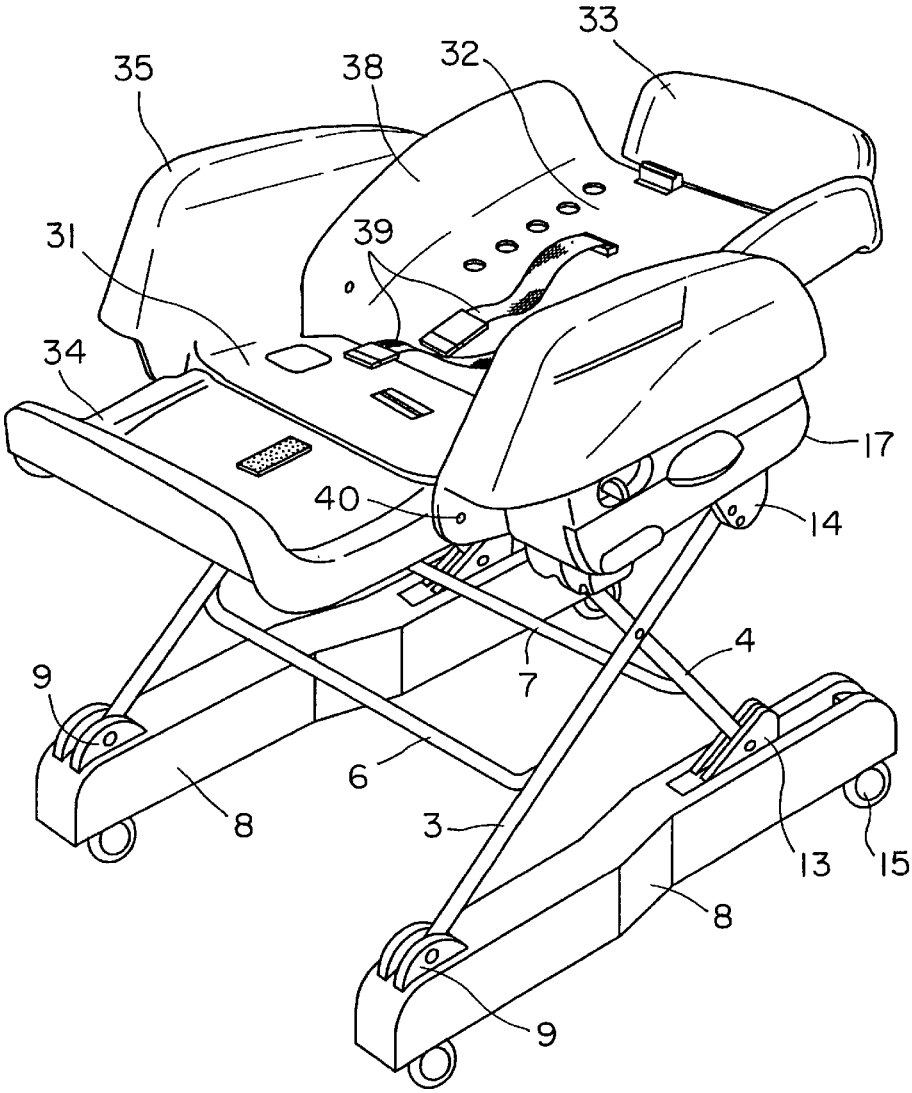
FIG. 7 is a perspective view of the child chair shown in FIG. 1, in which a back member is tilted.

As shown in FIG. 11, an interlocking mechanism is disposed on an upper part of the back member 32. The interlocking mechanism interlocks the back member 32 and the headrest 33 such that the headrest 33 is inclined at an optimum inclination according to the inclination of the back member 32. A support shaft 63 is inserted for sliding in the slots 57 of the swing cover 54. A connecting member 64 has one end connected to the support shaft 63 and the other end connected for turning to a shaft 65 disposed apart from (eccentric with respect to) the support shaft 41. When the back member 32 is laid down at a large inclination to the vertical, the support bar 50 moves upward in the slots 57 and pushes the connecting member 64. Consequently, the connecting member 64 turns the headrest 33 counterclockwise, as viewed in FIG. 11, to set the headrest 33 in a standing position. The headrest 33 set in the standing position is able to restrain the head of the child lying on the child seat 1 from moving out of the child seat 1. In FIG. 7, the bottom member 31 and the back member 32 are set substantially in a horizontal position.

The connecting member 64 is biased downward along the slots 57 by a spring 66. When force applied to the connecting member 64 by the support bar 50 is removed, the connecting member 64 is returned to its original position. Grooves 70 opening downward are formed on the lower surface of the bottom member 31, and the two swing bars 21 are engaged in the grooves 70. The swing bars 21 engaged in the grooves 70 are retained in the grooves 70 with clips, not shown.

As apparent from the foregoing description, according to the present invention, the right and the left X-shaped leg assemblies, each constructed by pivotally joining the middle parts of the front and the rear leg are connected to the parallel bases, the lower ends of one of the front leg and the rear leg of each X-shaped leg assembly is pivotally connected to the base, and the lower end of the other of the front leg and the rear leg is supported for longitudinal sliding and turning on the bases. Therefore, even when the surface of the seat on which the child is seated is at a high height from the ground, the height of the X-shaped leg assemblies, i.e., the length of the front and the rear legs, can be reduced by the height of the bases, and the longitudinal size of the front and rear legs can be reduced when storing the child chair. Since the casters can be attached to the lower surface of the stable bases, any complicated adjusting mechanism for adjusting the angle of the axes of the casters is unnecessary, and allowable errors in machining and assembling may be comparatively large.

What is claimed is:

1. A child chair comprising:

a pair of elongate bases each base being provided with a longitudinal groove;

a guide rod fixed to each base and extending longitudinally in said groove;

a slide block engaged with each guide rod so as to slidably move;

a pair of X-shaped leg assemblies, each formed by pivotally joining a front leg and a rear leg, and connected to the base; and a child seat supported on the pair of X-shaped leg assemblies;

wherein one of the front and the rear legs of each X-shaped leg assembly has a lower end pivotally connected to the base, and the other of the front and the rear legs has a lower end pivotally connected to the slide block and movable in a longitudinal direction.

2. The child chair according to claim 1, wherein the slide block has a sliding part slidably engaged with the guide rod, and a raised part longitudinally extending outwardly from the sliding part, and the lower end of either the front or the rear leg is pivotally connected to the raised part.

3. The child chair according to claim 2, wherein the raised part of the slide block projects outwardly from the base when the X-shaped leg assembly is folded.

4. A child chair comprising:

a pair of elongate bases;

a pair of X-shaped leg assemblies, each formed by pivotally joining a front leg and a rear leg, and connected to the base; and a child seat supported on the pair of X-shaped leg assemblies;

wherein one of the front and the rear legs of each X-shaped leg assembly has a lower end pivotally connected to the base, and the other of the front and the rear legs has a lower end pivotally supported on the base and movable in a longitudinal direction; and wherein middle parts of the pair of bases are curved such that a space between front parts of the bases and a space between rear parts of the bases are different from each other, the front leg of each X-shaped leg assembly is connected to the front part of the base, and rear leg of each X-shaped leg assembly is connected to the rear part of the base.

5. The child chair according to claim 1, wherein casters are detachably connected to lower surface of each of the bases.

6. The child chair according to claim 1, wherein seat support members are connected to the upper ends of the pair of X-shaped leg assemblies, respectively, and the child seat is supported in a swinging manner on the seat support members.

7. The child chair according to claim 1, wherein the child seat has a bottom member, a back member pivotally connected to a rear part of the bottom member, a headrest pivotally connected for turning to an upper part of the back member, and a step connected in a swinging manner to a front part of the bottom member.

8. The child chair according to claim 7, wherein a connecting bar is extended between the back member and the step to interlock the back member and the step.

9. The child chair according to claim 7, wherein recesses are formed at intervals on the back surface of the back member, and a support bar is pivotally supported on the bottom member so as to engage in one of the recesses of the back member.

10. The child chair according to claim 9, wherein the headrest is supported for turning on the back member by a support shaft, a connecting member has one end pivotally connected to a part of the headrest, which is eccentric with respect to a support shaft supporting the headrest, and the other end pushed by the support bar.

11. The child chair according to claim 9, wherein a swing cover is supported for turning on the back surface of the back member.

12. The child chair according to claim 11, wherein the swing cover is provided with slots through which the support bar is extended.

* * * * *